US005171652A

United States Patent [19]

Umetani

[11] Patent Number: 5,171,652

[45] Date of Patent: Dec. 15, 1992

[54] IMAGE-FORMING PROCESS AND MAGNETIC DEVELOPING SLEEVE FOR USE IN CARRYING OUT THE SAME

[75] Inventor: Yosinobu Umetani, Yamato-takada, Japan

[73] Assignee: Mita Industrial Co., Ltd., Osaka, Japan

[21] Appl. No.: 672,014

[22] Filed: Mar. 19, 1991

[30] Foreign Application Priority Data

Mar. 19, 1990 [JP] Japan ..... 2-71570

[51] Int. Cl.[5] ..... G03G 13/44; G03G 13/24

[52] U.S. Cl. ..... 430/102; 430/55; 430/33

[58] Field of Search ..... 430/102, 55, 33, 901

[56] References Cited

U.S. PATENT DOCUMENTS 5,031,570 7/1991 Hays et al. ..... 430/122

*Primary Examiner*—Marion E. McCamish
*Assistant Examiner*—S. Rosasco
*Attorney, Agent, or Firm*—Sherman and Shalloway

[57] ABSTRACT

In forming an image by the simultaneous light exposure-transfer process using a photosensitive toner, a light-exposed electricity-removed toner is effectively scraped without bad influences on the image density, and the fog density is drastically reduced.

In subjecting a photosensitive toner layer to imagewise light exposure to form a combination of an electricity-removed toner and a charged toner and removing the electricity-removed toner from an electroconductive substrate by contact with a magnetic brush, the flux density distribution of a main developing pole in a developing sleeve is set so that a two-peak flux density distribution having two peaks separated on the upstream side and downstream side with the vicinity of the nip position between the developing sleeve and electroconductive substrate being as the center is produced in the tangential direction and the value of the peak on the downstream side is smaller than the value of the peak on the upstream side.

8 Claims, 7 Drawing Sheets

IMAGE-FORMING PROCESS AND MAGNETIC DEVELOPING SLEEVE FOR USE IN CARRYING OUT THE SAME

BACKGROUND OF THE INVENTION (1) Field of the Invention

The present invention relates to an electophotographic image-forming process and a magnetic developing sleeve for use in carrying out this process. More particularly, the present invention relates to an improvement in the process for forming a sharp image having reduced fogging from a mixture of a photosensitive toner and a magnetic carrier.

(2) Description of the Related Art

The image-forming process using a photosensitive toner has been known from old, and there has already been proposed a process in which an image is formed by simultaneously performing light exposure and image transfer with application of voltage. For example, Japanese Unexamined Patent Publication No. 60-98463 and Japanese Unexamined Patent Publication No. 60-138566 disclose a process in which a photosensitive toner layer is formed on an electroconductive substrate, a transparent electrode is disposed to confront the toner layer, a bias voltage is applied so that the toner-applied side of the substrate has a polarity reverse to that of the toner and the counter electrode side of the substrate has the same polarity as that of the toner, imagewise light exposure is carried out, and the irradiated toner image is transferred to the counter electrode side.

However, in the above-mentioned simultaneous voltage application-light exposure-transfer process, charges of a polarity reverse to the polarity inherently possessed by the toner are injected in the photosensitive toner of the light exposure zone (bright zone), and this toner charged with the reverse polarity is electrostatically attracted to the counter electrode side to effect formation of an image. Accordingly, the image formed by the above-mentioned process is a negative image, and because of the principle of this image-forming process, it is impossible to form a positive image on the counter electrode side according to the above-mentioned process.

In Japanese Unexamined Patent Publication No. 01-137270, we have proposed an image-forming process in which two electrode surfaces, at least one of which has a curvature surface and at least one of which is transparent, are arranged to confront each other, a photosensitive layer is formed on one electrode surface, a bias voltage is applied so that the toner layer-supporting electrode surface has the same polarity as that of the toner charge and the counter electrode surface has a polarity reverse to that of the toner charge, the toner layer is irradiated with light at a position where both the electrode surfaces are brought into contact with each other through the photosensitive toner layer and the unexposed toner is transferred to the counter electrode side to effect formation of an image. It is taught that an electroconductive sleeve having a magnet disposed in the interior thereof is used as an electroconductive supporting electrode surface for the above-mentioned toner layer-supporting electrode surface and a photosensitive toner is used in the form of a magnetic brush of a mixture with a magnetic carrier for formation of an image.

This process proposed by us is advantageous in that a positive image can be formed by the simultaneous voltage application-light exposure-transfer process, and the above-mentioned magnetic brush performs simultaneously adhesion of the charged photosensitive toner and scraping of the light-exposed electricity-removed toner from the surface of the transparent electrode. However, scraping of the light-exposed electricity-removed toner from the surface of the transparent electrode is not sufficiently performed and therefore, a problem of fogging on the formed image arises.

More specifically, in the process for forming an image through the steps of supplying a mixture of a photosensitive toner and a magnetic carrier onto a developing sleeve having a magnet disposed in the interior thereof to form a magnetic brush of the mixture, bringing the magnetic brush into contact with an electroconductive substrate to form a photosensitive toner layer on the substrate, subjecting the photosensitive toner layer to imagewise light exposure to form a combination of the electricity-removed toner and the charged toner, and removing the electricity-removed toner from the electroconductive substrate by the contract with the magnetic brush, scraping of the electricity-removed toner from the electroconductive substrate is very important. Namely, only by removal of electricity or application of a bias voltage between the developing sleeve and the electrode surface, it is difficult to completely remove the photosensitive toner which has once adhered to the electroconductive substrate, and even by performing the sliding contact with the magnetic brush, complete removal of this photosensitive toner is impossible and fogging is caused to such a degree as degrading the sharpness of the image.

SUMMARY OF THE INVENTION

It is therefore a primary object of the present invention to overcome the above-mentioned defects of the conventional image-forming process and provide an image-forming process in which the fog density is drastically reduced and a magnetic developing sleeve for use in carrying out this image-forming process.

Another object of the present invention is to provide a magnetic brush image-forming process in which a light-exposed electricity-removed toner is effectively scraped from a substrate without bad influences on the density of a formed image, whereby the fog density can be prominently reduced.

In accordance with one aspect of the present invention, there is provided an image-forming process comprising steps of supplying a mixture of a photosensitive toner and a magnetic carrier onto a developing sleeve having a magnet disposed therein to form a magnetic brush of the mixture on the developing sleeve, bringing the magnetic brush into contact with an electroconductive substrate to form a photosensitive toner layer on the electroconductive substrate, subjecting the photosensitive toner layer to imagewise light exposure to form a combination of the electricity-removed toner and the charged toner, and removing the electricity-removed toner from the electroconductive substrate by contact with the magnetic brush, wherein the flux density distribution of the main pole of the developing sleeve is set so that the flux density distribution in the tangential direction is a two-peak distribution having two peaks separated on the upstream side and downstream side with the vicinity of the nip position between the developing sleeve and the electroconductive plate being as the center, and the peak on the downstream side has a smaller value than the peak on the upstream side.

In accordance with another aspect of the present invention, there is provided a magnetic developing sleeve comprising a rotatable electroconductive sleeve and a magnet having a developing main pole, which is contained in the electroconductive sleeve, wherein a magnetic brush of a developer comprising a mixture of a toner and a magnetic carrier is formed on the surface of the sleeve and a toner image is formed on the surface of a drum by sliding contact with the surface of the drum, said magnetic developing sleeve being characterized in that the main pole of the developing sleeve has such a flux density distribution that the flux density distribution in the tangential direction is a two-peak distribution having two peaks separated on the downstream side and upstream side with the vicinity of the nip position between the developing sleeve and the drum being as the center, the peak on the downstream side has a smaller value of the flux density than that of the peak on the upstream side, and the apex of the peak on the downstream side is partial to the downstream side over the center of the width of the peak on the downstream side.

The ordinary flux density or the distribution thereof is expressed by the value as measured in the normal direction, but the flux density distribution referred to in the instant specification means a value measured in the tangential direction. Namely, the flux density is determined by detecting a magnetic force line passing across the hole element. The flux density distribution in the normal direction is measured while locating the measurement surface in the direction orthogonal to the normal line, but the flux density distribution in the tangential direction is measured by overlapping the measurement surface on the normal line. In this point, both the flux density distributions differ.

DETAILED DESCRIPTION OF THE INVENTION

The present invention is based on the novel finding that if the flux density distribution of the main pole in the developing sleeve is controlled to satisfy the following conditions:

(i) the flux density distribution in the tangential direction is a two-peak flux density distribution having two peaks separated on the upstream side and downstream side with the vicinity of the nip position between the developing sleeve and the conductive substrate being as the center;

(ii) in this two-peak distribution, the peak on the downstream side has a smaller value than the peak on the upstream side; and (iii) preferably, the apex of the peak on the downstream side is partial to the downstream side over the center of the width of the peak on the downstream side; scraping of the light-exposed electricity-removed toner from the electrode surface by the magnetic brush can be effectively performed.

Figure 1:
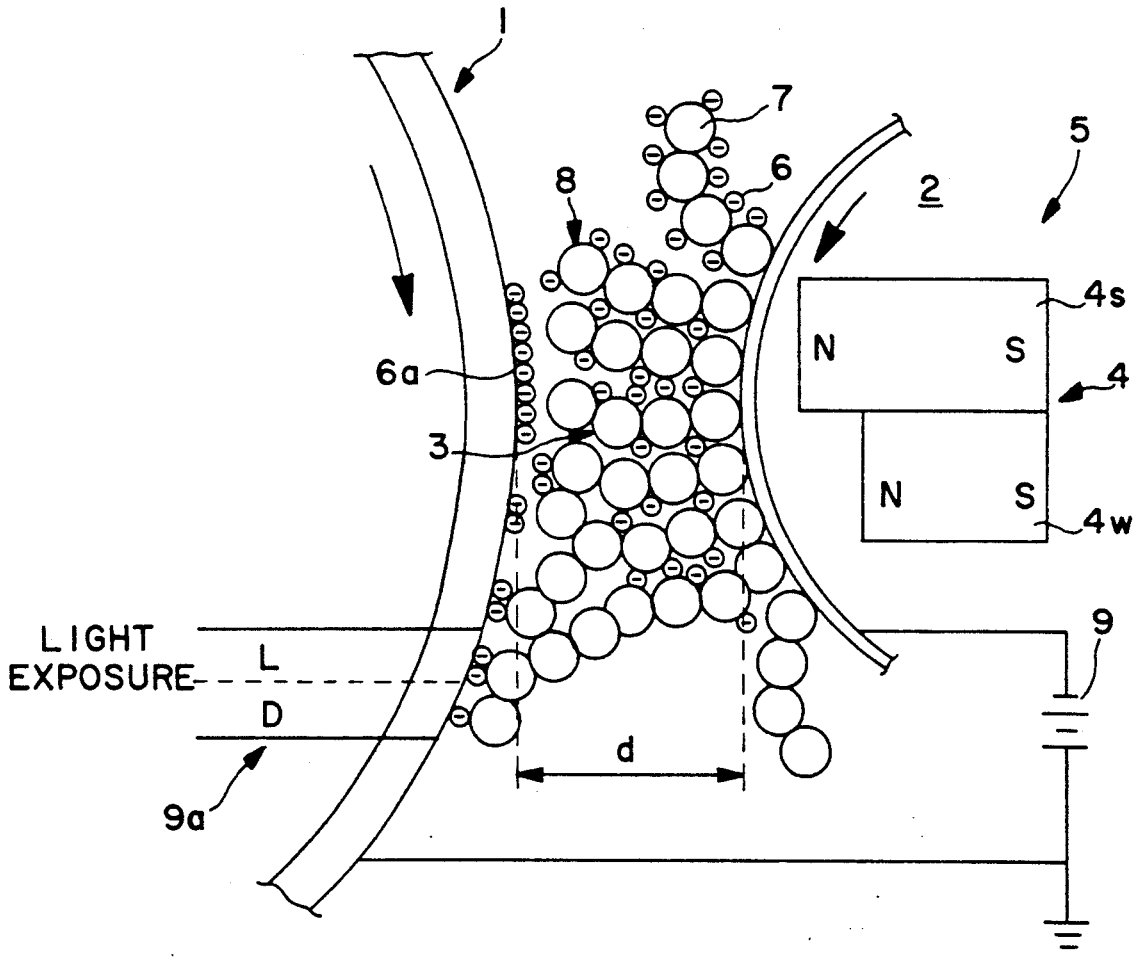
FIG. 1 is a diagram illustrating the principle of the present invention (an enlarged sectional view of the developing zone).

Referring to FIG. 1 illustrating the principle of the present invention, an electrode surface 1 on which a toner image is to be formed is arranged to confront a developing sleeve 2 with a minute distance d there between. The electrode surface (electroconductive substrate) 1 and the developing sleeve 2 are driven and rotated in the same direction at a nip position 3. Namely, in FIG. 1, the electrode surface 1 is rotated clockwise and the developing sleeve 2 is rotated counterclockwise. The developing sleeve 2 is composed of a non-magnetic material, and a magnet roll 5 having a developing main pole 4 is arranged in the interior of the developing sleeve 2. A mixture of a photosensitive toner 6 and a magnetic carrier 7 is supplied to the surface of the developing sleeve 2 to form a magnetic brush 8 comprising the photosensitive toner 6 charged with a certain polarity. Upstream of the nip position 3, the magnetic brush 8 is brought into contact with the electrode surface 1 to form a photosensitive toner layer 6*a* on the electrode surface 1. In order to facilitate the formation of the photosensitive toner 6*a*, a bias voltage is applied onto the electrode surface 1 with a polarity reverse to that of the charge of the photosensitive toner form a power source 9. Within the nip position 3, the photosensitive toner layer 6*a* is subjected to light exposure to form a combination of the electricity-removed toner and the charged toner. This light exposure is performed, for example, by using a transparent electrode surface as the electrode surface 1 and an optical path 9*a* passing through this transparent electrode surface. In the light zone L, removal of electricity from the charge is effected by the photoconductivity of the photosensitive toner, and in the dark zone D, the charge of the photosensitive toner is retained. Downstream of the nip position, the electricity-removed toner is scraped by the magnetic brush while leaving only the charged toner on the electrode surface 1, whereby the formation of an image is effected. Incidentally, it is preferred that the imagewise light exposure position be located slightly downstream of the most proximate position between the drum and sleeve, so that fogging (development) after the light exposure is reduced and scraping of the electricity-removed toner is performed simultaneously with or after the lapse of a very short time from the point of the light exposure.

Figure 2:
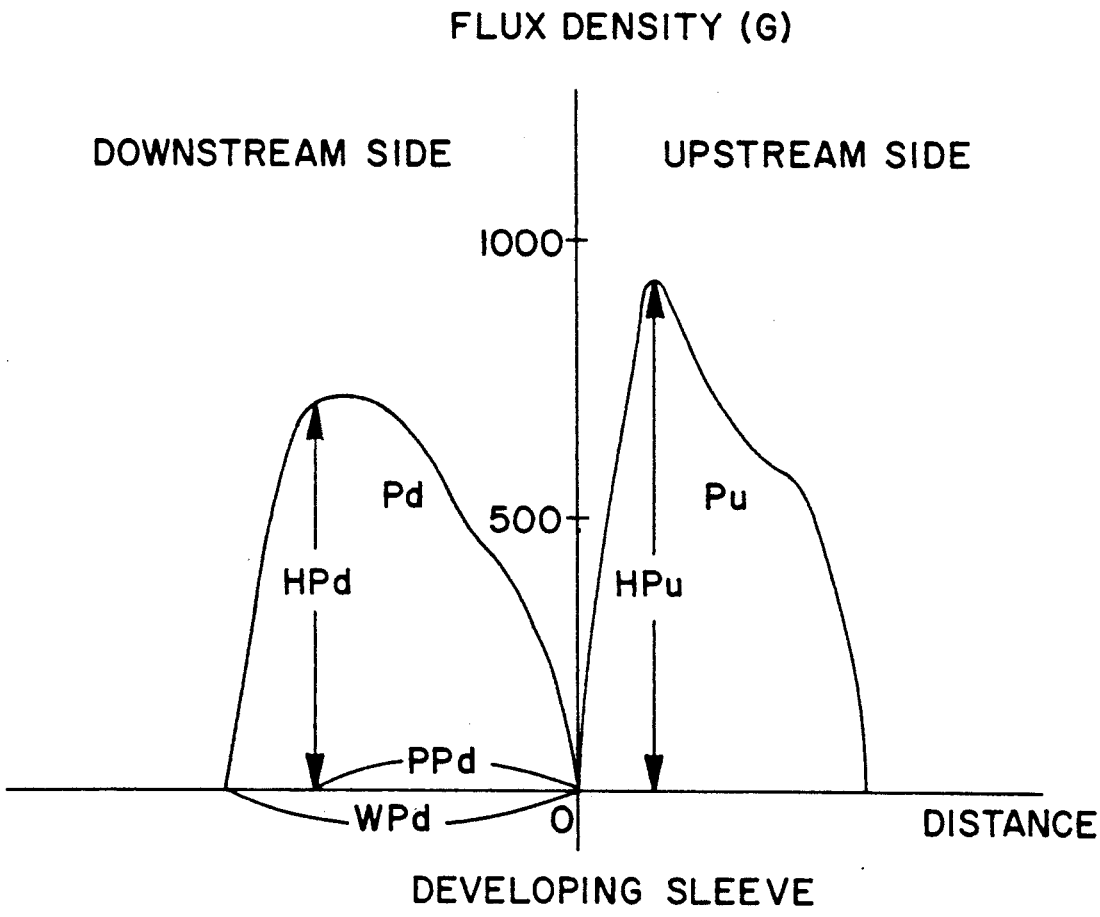
FIG. 2 is a graph showing the flux density distribution in the tangential direction formed on the sleeve by the developing main pole.

In the present invention, the flux density distribution formed in the tangential direction on the sleeve 2 by the main developing pole 4 is adjusted as shown in the graph of FIG. 2. In this graph, the position (distance) on the circumference of the developing sleeve 2 developed as a straight line is plotted on the abscissa, and the right side indicates the upstream side and the left side indicates the downstream side. The flux density (gauss) is plotted on the ordinate. From this graph, it is seen that under developing conditions of the present invention, there is produced a two-peak magnetic flux density distribution having two peaks completely separated from each other on the upstream side and downstream side with the position of $x=0$ being as the center, the height (HPd) of the peak (Pd) on the downstream side is lower than the height (HPu) of the peak (Pu) on the downstream side, and preferably, the apex of the peak (Pd) on the downstream side is partial to the downstream side over the center of the width of the peak on the downstream side. The degree of this partialization is expressed by 2PPd/WPd in which WPd represents the width of the peak on the downstream side and PPd represents the distance in the circumferential direction between the rising position of the peak on the downstream side and the apex of the peak.

FIGS. 3 through 6 show typical instances where the flux density distribution on the developing sleeve is actually changed.

Figure 3:
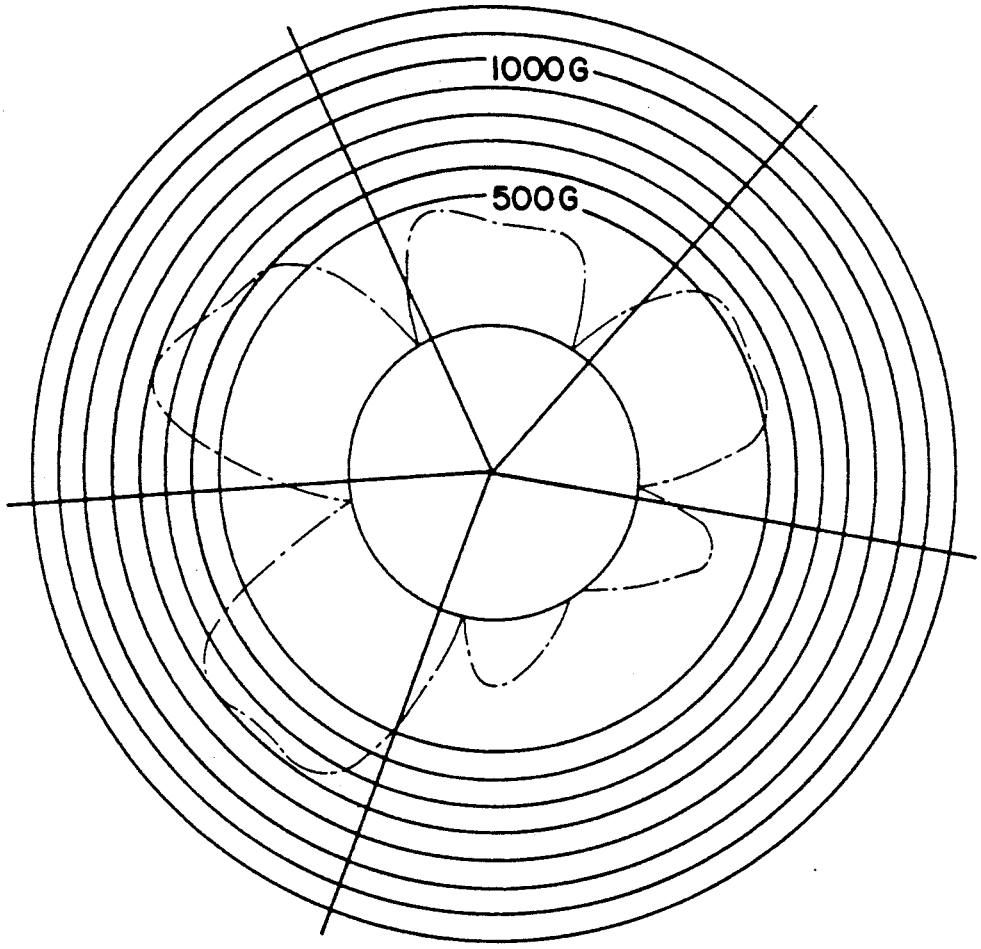
FIG. 3 is a graph showing the flux density distribution formed under developing conditions of Comparative Example 1.

FIG. 3 shows an instance where the peak on the upstream side and the peak on the downstream side have substantially the same shape, and the value of HPd/HPu is about 1. Under developing conditions producing this flux density distribution, as shown in Comparative Example 1 given hereinafter, the fog density is as high as 0.02 and the sharpness of the image is poor.

Figure 4:
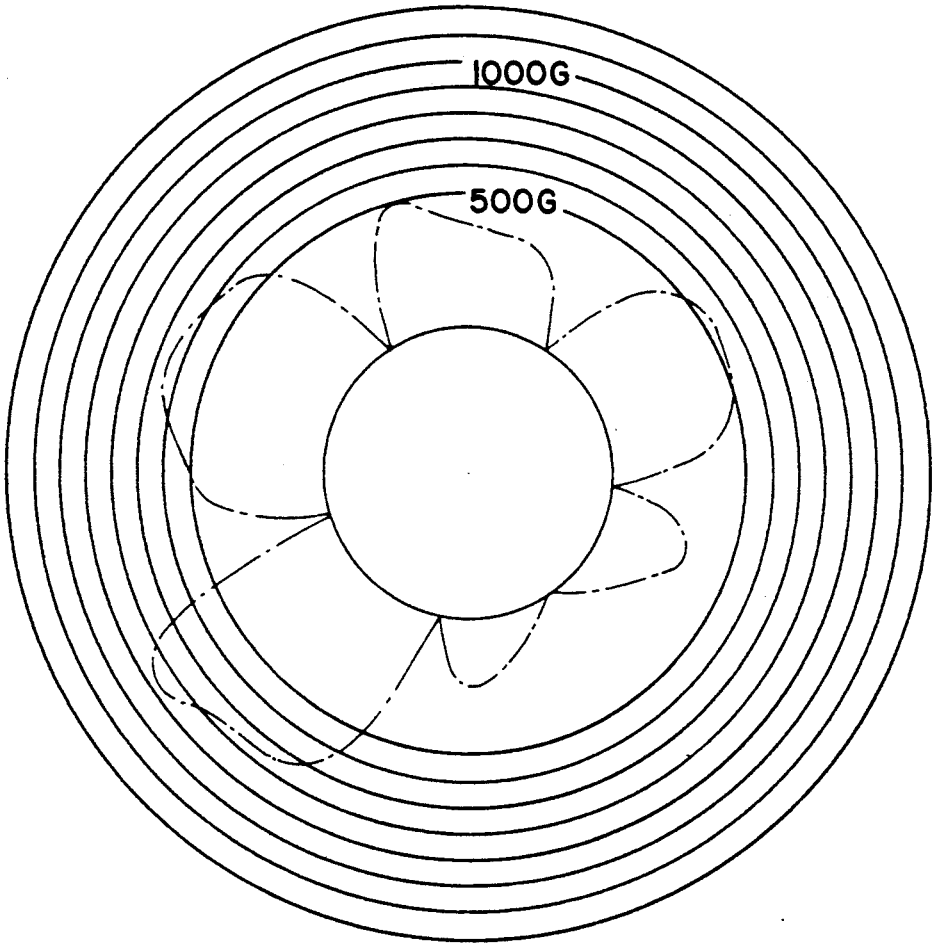
FIG. 4 is a graph illustrating the flux density distribution formed under developing conditions of Comparative Example 2.

FIG. 4 shows an instance where the peak on the downstream side is higher than the peak on the upstream side ($HPd/HPu>1$) contrary to the present invention, and under developing conditions producing this magnetic flux density, as shown in Comparative Example 2 given hereinafter, the fog density is as high as 0.07 and the sharpness of the image is poor.

Figure 5:
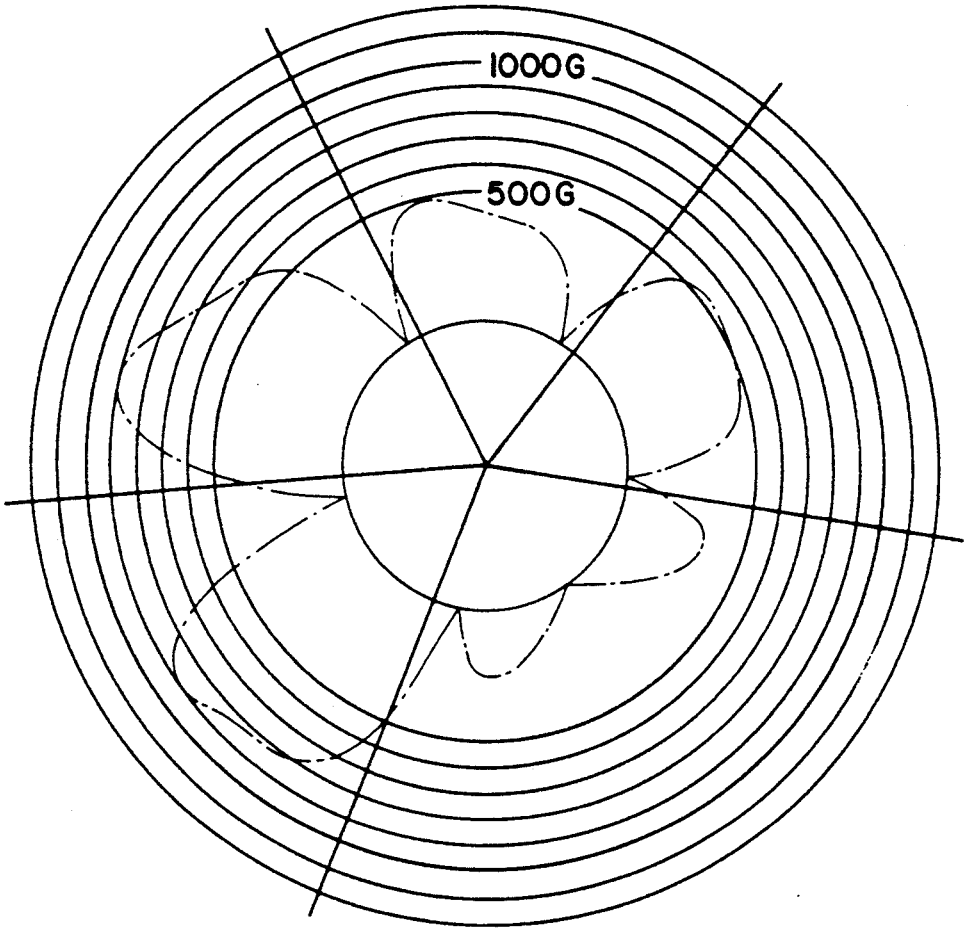
FIG. 5 is a graph illustrating the flux density distribution formed under developing conditions of Comparative Example 3.

In an instance shown in FIG. 5, the peak on the downstream side is bilaterally symmetric and the value of 2PPD/WPd is about 1. Under developing conditions producing this magnetic flux density, even if the condition of $HPd/HPu<1$ according to the present invention is satisfied, as shown in Comparative Example 3 given hereinafter, the fog density is apt to increase.

Figure 6:
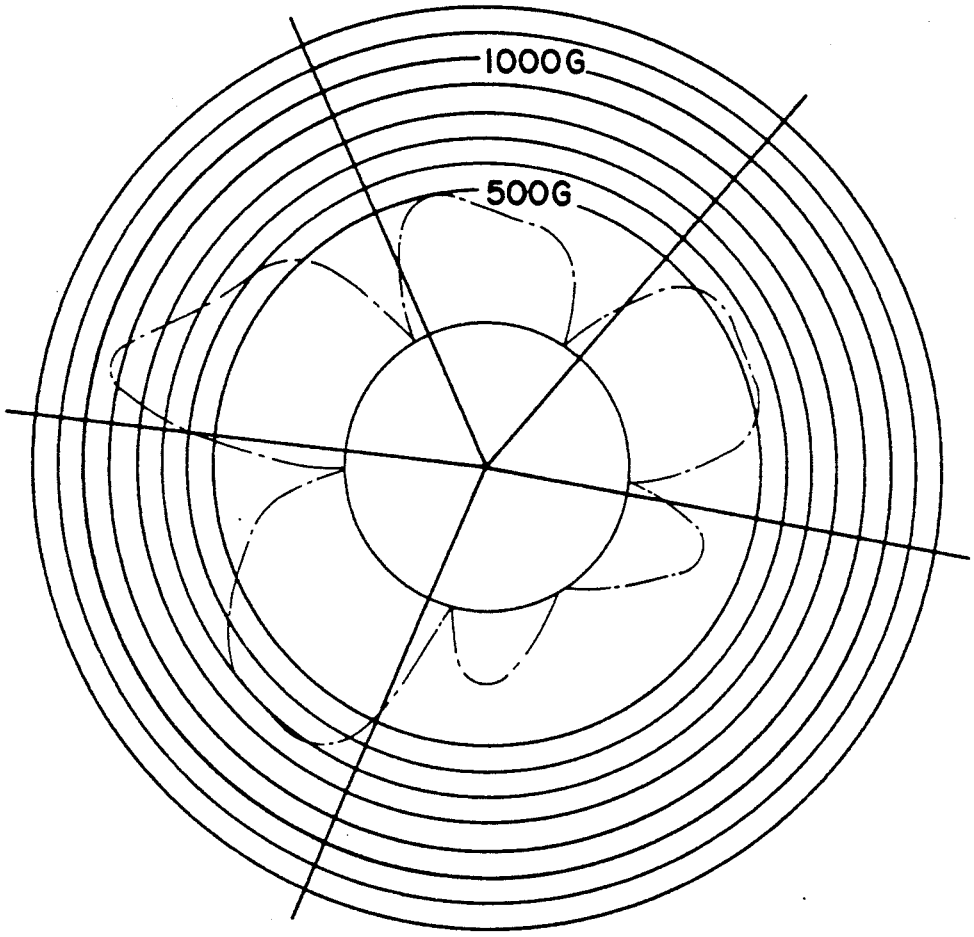
FIG. 6 is a graph illustrating the flux density distribution formed under developing conditions of Example 1 according to the present invention.

FIG. 6 shows an instance where both of the conditions of $HPd/HPu<1$ and $2PPd/WPd>1$ specified in the present invention are satisfied, and under developing conditions producing this magnetic flux density, as shown in Example 1 given hereinafter, the fog density is drastically reduced and a sharp image can be formed.

In the present invention, it is quite surprising that by satisfying the above-mentioned conditions (i) and (ii) and preferably, the condition (iii), on the developing sleeve, scraping of the light-exposed electricity-removed toner can be effectively accomplished. Namely, it is expected that in order to accomplish scraping of the light-exposed electricity-removed toner effectively, it will be necessary to increase the peeling force in the tangential direction on the side downstream of the center of the nip position, that is, to increase the flux density distribution in the tangential direction. According to the present invention, contrary to this expectation, it has been found that by maintaining the flux density distribution in the tangential direction on the downstream side at a lower level and partializing the apex of the peak on the downstream side to the downstream side, scraping of the electricity-removed toner is effectively accomplished. This finding is unexpected one.

The above-mentioned fact was found as the result of many experiments and investigations, and although the reason of this fact has not been completely elucidated, it is considered that reduction of the flux density distribution will be rather effective for attraction of the electricity-removed to the magnetic carrier surface.

One preferred embodiment of the present invention will now be described in detail.

Figure 7:
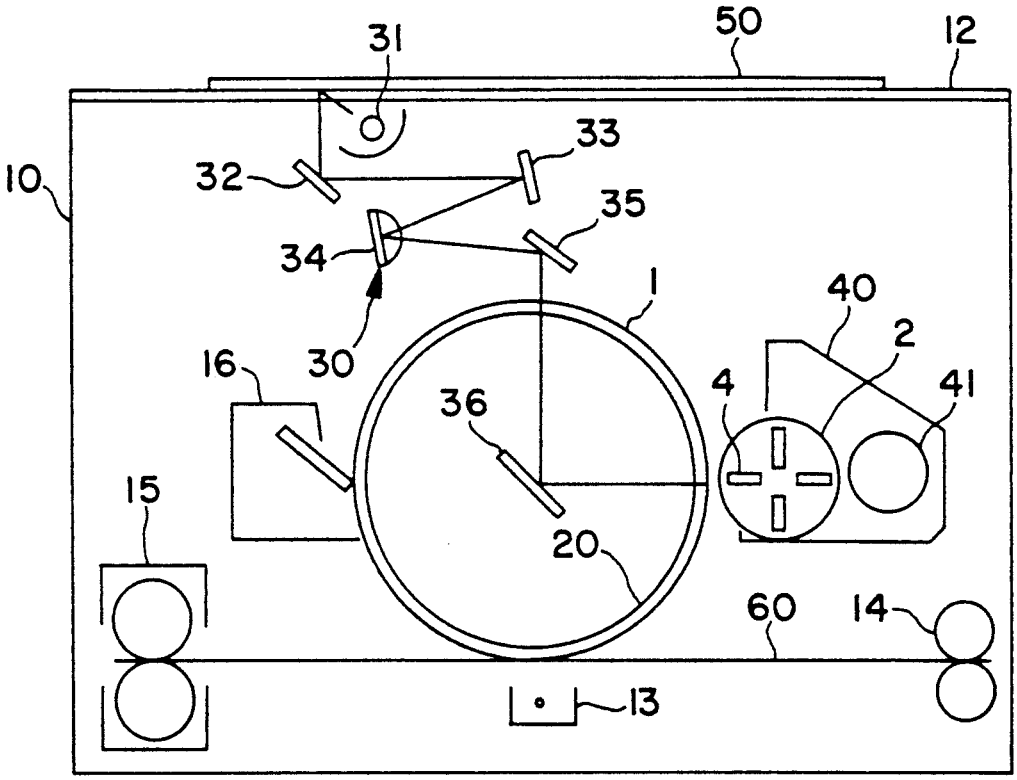
FIG. 7 is a schematic view illustrating the structure of a copying machine for use in carrying out the image forming process of the present invention.

FIG. 7 is a schematic diagram illustrating the structure of a copying machine for use in carrying out the image-forming process of the present invention. In this copying machine, a transparent electrode drum 20 having a transparent electrode 1 is rotatably disposed substantially in the central portion of a machine body 10. An original-placing stand 12 having an original object to be copied 50 placed thereon is arranged on the top surface of the machine body 10. The original-placing stand 10 is formed, for example, of transparent glass. The original object 50 placed on the original-placing stand 12 is exposed to light from an optical system 30 disposed below the original-placing stand 12. For example, the optical system comprises a light source 31, a first moving mirror 32, a second moving mirror 33, an in-mirror lens 34, a fixed mirror 35 and a light exposure mirror 36 fixed substantially in the central portion of the interior of the transparent electrode drum 20. The light projected from the light source 31 on the original object 50 on the original-placing stand 12 is reflected from the original object 50 and is projected on the light exposure mirror 36 disposed in the interior of the transparent electrode drum 20 by the first moving mirror 32, second moving mirror 33, in-mirror lens 34 and fixed mirror 35. The light exposure rays of the original object projected on the light exposure mirror 36 from above the transparent electrode drum 20 are reflected by the light exposure mirror 36 substantially orthogonally.

A developing apparatus 40 is arranged in the side portion of the transparent electrode drum 20. The developing apparatus 40 has in the interior thereof a stirring roller 41 for mixing a photosensitive toner and a carrier, to be fed into the developing apparatus 40, and a developing sleeve 2 for delivering a mixture of the photosensitive toner and magnetic carrier formed by the stirring roller 41. The developing sleeve 2 confronts the transparent electrode drum 20 and is arranged rotatably in the direction opposite to the rotation direction of the transparent electrode drum 20. The light exposure mirror 36 disposed in the interior of the transparent electrode drum 20 reflects the light exposure rays of the original 50 to the position confronting the developing sleeve 2 in the transparent electrode drum 20.

The surface of the developing sleeve 2 is electrically conductive, and for example, four magnets are arranged in the interior of the developing sleeve 2. A main pole magnet 4 is arranged in a state confronting the transparent electrode drum 20 through the circumferential face of the developing sleeve 2, and other magnets are arranged in sequence at angle intervals of 90° in the rotation direction of the developing sleeve 2. Each magnet forms a magnetic brush of the magnetic carrier on the peripheral surface of the developing sleeve 2. By rotation of the developing sleeve 2, the photosensitive toner is delivered in a state adhering to the magnetic brush.

A bias voltage is applied between the transparent electrode drum 20 and the developing sleeve 2. In the present embodiment, as shown in FIG. 1, the transparent electrode drum 20 is grounded, the developing sleeve 2 is connected to a bias power source 9, and a bias voltage of a negative polarity is applied.

Below the transparent electrode drum 20, a transfer apparatus 13 is arranged to confront the peripheral surface of the transparent electrode drum 20. Below the developing apparatus 40, a delivery roller 14 is arranged to deliver a transfer sheet 60, and the transfer sheet 60 is delivered between the transfer apparatus 13 and the transparent electrode drum 20. As described hereinafter, the transfer apparatus 13 transfers a toner image formed on the circumferential face of the transparent electrode drum 20 onto the transfer sheet 60. The transfer sheet 60 having the toner image transferred thereon is delivered to a fixing apparatus 15 and the toner image is fixed on the transfer sheet 60. A cleaning apparatus 16 is arranged in the transparent electrode drum 20 on the side opposite to the side where the developing apparatus 40 is arranged. After the toner is transferred onto the transfer sheet 60 by the transfer apparatus 13, the toner left on the transparent electrode drum 20 is removed by the cleaning apparatus 16.

In the present invention, the flux density distribution formed on the sleeve 2 by the developing main pole magnet 4 is set as shown in FIG. 6. The structure of the main pole magnet 4 is not particularly critical, so far as this flux density distribution is produced. For example, the main pole magnet 4 can be a side-by-side composite magnet comprising a strong magnet 4*s* located on the upstream side and a weak magnet 4*w* located on the downstream side, as shown in FIG. 1.

A magnetic brush of the magnetic carrier 7 is formed on the circumferential surface of the developing sleeve 2 by each of the magnets disposed within the developing sleeve 2. The photosensitive toner 6 is charged, for example, with a negative polarily, by stirring and mixing with the magnetic carrier 7, and is attracted by the Coulomb force of the magnetic carrier 7 and delivered on the peripheral face of the developing sleeve 2. The magnetic brush is brought into sliding contact with the transparent electrode 1 of the transparent electrode drum 20 at the position where the transparent electrode drum 20 and developing sleeve 2 confront each other. A voltage of the same polarity as that of the photosensitive toner is applied to the developing sleeve 2, and the transparent electrode drum 20 is grounded or is charged with the polarity (positive polarity) reverse to the charged polarity of the photosensitive toner 6. The photosensitive toner 6 of the negative polarity delivered on the peripheral surface of the developing sleeve 2 by the magnetic brush adheres in the form of a thin layer on the transparent electrode 1 of the transparent electrode drum 20. The layer 6*a* of the photosensitive toner 6 adhering onto the transparent electrode 1 of the transparent electrode drum 20 is irradiated with light exposure rays of the original 50 emitted from the light exposure mirror 36.

In the photosensitive toner on the transparent electrode drum 20, which has been irradiated with the light exposure rays of the original object 50, the irradiated light zone becomes electrically conductive and the accumulated charge is attenuated or a charge of the positive polarity is injected from the transparent electrode drum 20. In contrast, in the non-exposed dark zone in the photosensitive toner does not become electrically conductive but charging with the negative polarity is maintained.

When the layer 6*a* of the photosensitive toner 6 on the transparent electrode drum 20 is moved with rotation of the transparent electrode drum 20 in this state, the toner rendered electrically conductive in the light zone of the photosensitive toner layer 6 is scraped down from the circumferential surface of the transparent electrode drum 20 by the magnetic brush on the developing sleeve 2. In contrast, the photosensitive toner kept electrically negative in the dark zone of the photosensitive toner 6*a* on the transparent electrode drum 20 adheres onto the transparent electrode 1 of the transparent electrode drum 20 by the Coulomb force with the charge of the positive polarity, and therefore, this toner is not scraped but is kept adhering onto the transparent electrode drum 20 even if the magnetic brush on the circumferential surface of the developing sleeve 2 is brought into sliding contact with the circumferential surface of the transparent electrode drum 20.

At this point, since the magnetic field intensity of the magnet 4 forming a magnetic brush in the region where the developing sleeve 2 and transparent electrode drum 20 confront each other is strong in the upstream portion in the rotation direction of the developing sleeve 2 and is weak in the downstream portion, earing of the magnetic brush formed on the circumferential surface of the developing sleeve 2 is such that as shown in FIG. 1, the magnetic brush reaches the transparent electrode 1 of the transparent electrode drum 20 in the downstream portion of the developing sleeve 2 and extends along the transparent electrode drum 20 to the downstream side in the rotation direction of the transparent drum 20. Accordingly, this earing portion of the magnetic brush is assuredly brought into sliding contact with the circumferential surface of the transparent electrode drum 20, and by this earing portion of the magnetic brush, the photosensitive toner rendered electroconductive in the photosensitive toner layer 6*a* on the transparent electrode drum 20 is scraped down assuredly and separated from the transparent electrode drum 20. As the result, an image corresponding to the dark zone not irradiated with the light exposure rays of the original 50 is formed by the photosensitive toner.

The image of the photosensitive toner formed on the transparent electrode drum 20 is transferred on a transfer sheet 60 delivered by the transfer sheet delivery roller 14 by the transfer apparatus 13, and the toner image on the transfer sheet 60 is fixed to the transfer sheet 60 by the fixing apparatus 15. When the toner is transferred onto the transfer sheet 60, the toner left on the circumferential surface of the transparent electrode drum 20 is removed by the cleaning apparatus 16.

In the present invention, it is preferred that the above-mentioned value of HPd/HPu be in the range of from 1.0 to 0.4, especially from 0.8 to 0.5, and it also is preferred that the value of HPd be 900 to 350 gauss, especially 720 to 450, whereby the fog density is reduced without reduction of the image density. In order to further reduce the fog density, it is preferred that the degree of partialization of the peak on the downstream side, that is, the value of 2PPd/WPd, be in the range of from 1.9 to 1.1, especially from 1.8 to 1.2.

As the electroconductive substrate constituting the electrode, there can be used optional electroconductive substrates, for example, metals such as aluminum, tinplate and copper, composites formed by bonding or vacuum-depositing an aluminum foil onto a substrate of a plastic film such as a biaxially drawn polyester film, and electroconductive glass (NESA glass). A non-magnetic electroconductive material such as aluminum is preferably used for the developing sleeve, and electroconductive glass is preferably used for the image-forming electrode surface.

The photosensitive toner used in the image-forming process of the present invention is composed of particles of a composition formed by dispersing a photosensitive (photoconductive) substance in a fixing medium comprising an electrically insulating resin. As the photosensitive substance, there can be used inorganic photoconductors such as zinc oxide and Cds and photoconductive organic pigments such as a perylene pigment, a quinacridone pigment, a pyranthrone pigment, a phthalocyanine pigment, a disazo pigment and a trisazo pigment. It is preferred that the photoconductive substance be used in an amount of 3 to 600 parts by weight, especially 5 to 500 parts by weight, per 100 parts by weight of the fixing medium. If the amount of the photoconductive substance is below the above-mentioned range, the image density or toner sensitivity tends to decrease. If the amount of the photoconductive substance exceeds the above-mentioned range, the charge-retaining property is readily reduced.

A known electrically insulating fixing resin is used as the fixing medium. For example, there can be mentioned polystyrene, a styrene/acrylic copolymer, an acrylic resin, a polycarbonate, a polyarylate (a polyester of bisphenol A with isophthalic or terephthalic acid), polyvinyl butyral and a polysulfone. Furthermore, a photoconductive resin such as polyvinyl carbazole can be used alone or in combination with an electrically insulating resin.

In the case where the photoconductive substance has no sensitivity to wavelengths of the visible region, a known dye sensitizer or chemical sensitizer can be incorporated into the photoconductive substance.

Moreover, a photoconductive toner can be prepared by using a charge-transporting medium as the fixing medium and dispersing a photoconductive substance as mentioned above as the charge-generating pigment into this charge-transporting medium. The above-mentioned electrically insulating resin and charge-transporting substance are used in combination as the charge-transporting medium. Either a hole transporting substance or a charge-transporting substance can be used as the charge-transporting substance. As the hole-transporting substance, there can be mentioned, for example, polyvinyl carbazole, phenanthorene N-ethylcarbazole, 2,5-diphenyl-1,3,4-oxadiazole, 2,5-bis(4-diethylaminophenyl)-1,3,4-oxadiazole, bis-diethylaminophenyl 1,3,6-oxadiazole, 4,4'-bis(diethylamine)-2,2'-dimethyltriphenylmethane, 2,4,5-triaminophenylimidazole, 2,5-bis(4-diethylamino-phenyl(-1,3,4-triazole, 1-phenyl-3-(4-diethylaminostyryl)-5-(4-diethylaminophenyl)-2-pyrazoline and p-diethylamino-benzaldehydo-(diphenylhydrazone). As the charge-transporting substance, there can be mentioned, for example, 2-nitro-9-fluorene, 2,7-dinitro-9-fluorene, 2,4,7-trinitro-9-fluorene, 2,4,5,7-tetranitro-9-fluorene, 2-nitro-benzothiophene, 2,4,8-trinitroxanthone, dinitroanthracene, dinitroacrydine and dinitroanthraquinone. It is generally preferred that the charge-transporting substance be used in an amount of 10 to 200 parts by weight, especially 30 to 120 parts by weight, per 100 parts by weight of the resin.

In addition to the above-mentioned indispensable components, a known assistant can be incorporated according to a known recipe. As the assistant, there can be mentioned an offset-preventing agent such as a wax, and a pressure fixability-imparting agent.

Formation of the toner is accomplished by the dry method including kneading, pulverization and sieving, the wet method comprising spraying a dispersion to form particles, and the emulsion or suspension polymerization method comprising polymerizing a dispersion of a photoconductive monomer. Generally, the particle size of toner particles is preferably 5 to 30 microns.

A ferrite carrier and an iron powder carrier can be used as the magnetic carrier, and the particle size is preferably 30 to 120 μm. The carrier/toner mixing weight ratio is preferably in the range of from 97/3 to 85/15. The earing length of the magnetic brush depends somewhat on other conditions, but it is generally preferred that the earing length of the magnetic brush be 0.3 to 1 mm.

The bias voltage to be applied between the toner-supporting electrode and the counter electrode depends somewhat on the curvature radius of the curvature surface of the electrode, but it is preferred that the bias voltage be 100 to 2000 V, especially 300 to 1500 V.

The imagewise light exposure is effected by the transparent light exposure through a transparent original or by reflection light exposure using an opaque original. It is preferred that the slit light exposure be conducted in each case. In this light exposure, the slit width of the light exposure be narrower than the width of the portion of contact with the photosensitive toner, especially 0.5 to 3 mm.

EXAMPLES

The present invention will now be described in detail with reference to the following examples.

EXAMPLE 1

A sleeve having a flux density distribution shown in FIG. 6 in the tangential direction was mounted on a copying machine as shown in FIG. 7, and an image was formed in this copying machine by using a photosensitive toner.

Image-forming developing conditions adopted were as follows:

Drum diameter: 78 mm
Sleeve diameter: 38 mm
Peripheral speed of drum: 0.8 cm/sec
Sleeve/drum peripheral speed ratio: 5
Bias voltage: 1.2 kV
Drum-sleeve distance: 0.7 mm
Magnet cut length: 0.5 mm
The fog density of the formed image was measured by a densitometer (Sakura Densitometer PAD-5). The obtained results are shown in Table 1.

The flux density distribution was measured by using an electromagnetic gauss meter (GM-2430D supplied by INC) while adjusting the distance between the sleeve surface and the probe to 1 mm. Also HPd, HPu, HPd/HPu and 2PPd/WPd of the flux density distribution formed on the sleeve by the developing main magnet in the tangential direction are shown in Table 1.

COMPARATIVE EXAMPLE 1

In the same manner as described in Example 1, in image was formed by using a sleeve having a flux density distribution as shown in FIG. 3 in the tangential direction, and the fog density of the formed image was measured. The obtained results are shown in Table 1.

COMPARATIVE EXAMPLE 2

In the same manner as described in Example 1, an image was formed by using a sleeve having a flux density distribution shown in FIG. 4 in the tangential direction, and the fog density of the formed image was measured. The obtained results are shown in Table 1.

COMPARATIVE EXAMPLE 3

In the same manner as described in Example 1, an image was formed by using a sleeve having a flux density distribution shown in FIG. 5 in the tangential direction, and the fog density of the obtained image was measured. The obtained results are shown in Table 1.

TABLE 1

| | HPd (G) | HPu (G) | Hpd/ HPu | 2PPd/ WPd | Fog Density |
|---|---|---|---|---|---|
| Example 1 | 715 | 930 | 0.769 | 4.471 | 0.00 |
| Comparative Example 1 | 800 | 801 | 0.999 | 1.267 | 0.02 |
| Comparative Example 2 | 868 | 660 | 1.315 | 0.667 | 0.07 |
| Comparative Example 3 | 870 | 898 | 0.969 | 1.125 | 0.04 |

As is seen from Table 1, in Example 1 where the conditions of HPd/HPu<1 and 2PPd/WPd>1 were satisfied, the fog density was very low and a sharp image was obtained.

In contrast, in Comparative Example 1 where HPd was nearly equal to 1 and Comparative Example 2 where the value of HPd/HPu was larger than 1, the fog density was high and the obtained image was poor in sharpness. In Comparative Example 3 where 2PPd/WPd was nearly equal to 1, the fog density was high and the obtained image was poor in sharpness.

As is apparent from the foregoing description, in the electrophotographic process for forming an image by using a magnetic brush of a mixture of a photosensitive toner and a magnetic carrier, by adjusting the flux density distribution on the developing sleeve so that the flux density distribution in the tangential direction is a two-peak distribution having a peak on the downstream side and a peak on the upstream side, in which the peak on the downstream side is lower than the peak on the upstream side, according to the present invention, scraping of particles of the electricity-removed toner can be effectively performed, and therefore, the fog density can be significantly reduced.

I claim:

1. An image-forming process comprising steps of supplying a mixture of a photosensitive toner and a magnetic carrier onto a developing sleeve having a magnet disposed therein to form a magnetic brush of the mixture on the developing sleeve, bringing the magnetic brush into contact with an electroconductive substrate to form a photosensitive toner layer on the electroconductive substrate, subjecting the photosensitive toner layer to imagewise light exposure to form a combination of the electricity-removed toner and the charged toner, and removing the electricity-removed toner from the electroconductive substrate by contact with the magnetic brush, wherein the flux density distribution of the main pole of the developing sleeve is set so that the flux density distribution in the tangential direction is a two-peak distribution having two peaks separated on the upstream side and downstream side with the vicinity of the nip position between the developing sleeve and the electroconductive plate being as the center, and the peak on the downstream side has a smaller value than the peak on the upperstream side.

2. An image-forming process according to claim 1, wherein the flux density distribution of the main pole of the developing sleeve is set so that the apex of the peak on the downstream side is partial to the downstream side over the center of the width of the peak on the downstream side.

3. The process of claim 1 wherein the magnetic carrier has a particle size of from about 30 to about 120 microns.

4. The process of claim 1 wherein the toner has a particle size of from 5 to 30 microns.

5. The process of claim 1 wherein the mixing weight ratio of the carrier to toner is from 97:3 to 85:15.

6. The process of claim 1 wherein the magnetic brush has an earring length of from 0.3 to 1 mm.

7. The process of claim 1 wherein the imagewise light exposure is a slit light exposure having a slit width of light exposure that is narrower than the width of the light in contact with the photosensitive toner.

8. The process of claim 7 wherein the slit width of light exposure is about 0.5 to about 3 mm.

* * * * *